United States Patent [19]

Finger

[11] 4,026,684

[45] May 31, 1977

[54] AIR FILTRATION CASSETTE WITH ELECTROSTATIC PRECIPITATOR AND HAVING MULTIPLE FILTER ELEMENTS

[75] Inventor: Richard H. Finger, Hollywood, Fla.

[73] Assignee: Klykon, Inc., Miami, Fla.

[22] Filed: Sept. 15, 1975

[21] Appl. No.: 613,364

[52] U.S. Cl. ..... 55/126; 55/138; 55/146; 55/148; 55/151; 55/154; 55/316; 55/487

[51] Int. Cl.[2] ..... B03C 3/01

[58] Field of Search ..... 55/124–126, 55/136–139, 140–143, 145–148, 150–154, 316, 487

[56] References Cited

UNITED STATES PATENTS

| | | | |
|---|---|---|---|
| 2,535,696 | 12/1950 | Richardson | 55/143 |
| 2,822,057 | 2/1958 | Richardson | 55/143 |
| 3,626,669 | 12/1971 | Cardiff | 55/126 |
| 3,665,679 | 5/1972 | McLain et al. | 55/126 |
| 3,707,828 | 1/1973 | Burney | 55/143 |
| 3,849,090 | 11/1974 | Remick | 55/126 |
| 3,854,903 | 12/1974 | Tomaides | 55/151 |

FOREIGN PATENTS OR APPLICATIONS

| | | | |
|---|---|---|---|
| 2,028,153 | 10/1971 | Germany | 55/126 |

*Primary Examiner*—Bernard Nozick
*Attorney, Agent, or Firm*—Jackson & Jones Law Corp.

[57] ABSTRACT

A filter cassette is disclosed, for use in an air filtering system, which has a central supporting frame, inside of which an electrostatic filtering device is mounted, and on each side of which are carrier flanges adapted to receive separate removable filtering elements. The entire filtering cassette is designed to be removed from the air filtering system for servicing; and the filtering elements supported by the carrier flanges may be varied in different installations to suit the specific filtering needs.

5 Claims, 12 Drawing Figures

FIG. 7
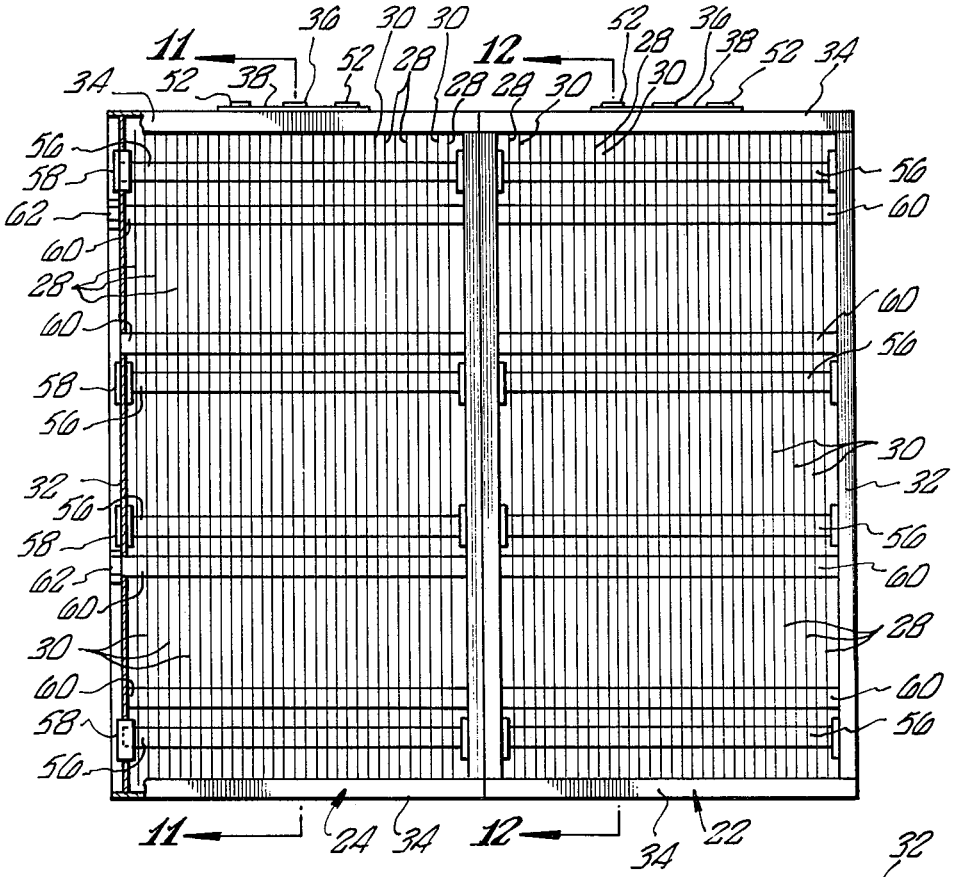
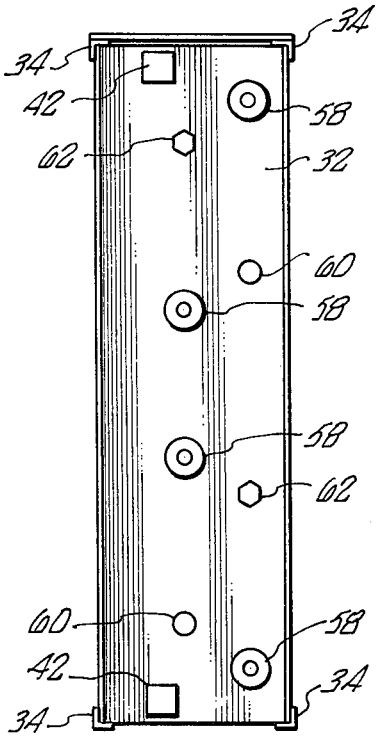
FIG. 8
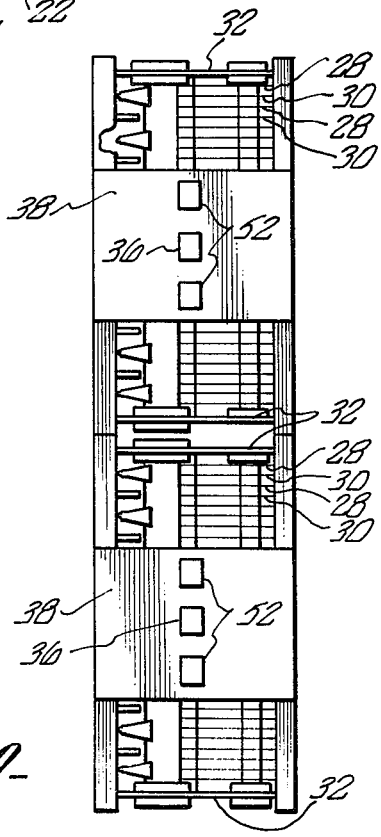
FIG. 9

AIR FILTRATION CASSETTE WITH ELECTROSTATIC PRECIPITATOR AND HAVING MULTIPLE FILTER ELEMENTS

BACKGROUND OF THE INVENTION

This invention is intended primarily to provide an air filtering unit suitable for commercial institutions, where it is important to move substantial amounts of air which is filtered thoroughly by a plurality of filtering elements designed to accomplish a variety of filtering functions.

There are, of course, various filtering systems in which a plurality of separate filtering units are installed in a series arrangement. Such units may include an electrostatic filtering element, polyurethane foam elements, carbon filters for odor absorption, etc. In most of the known arrangement, the separate types of filter elements are separately installed in and removed from the air filtering system. There are, in the prior art, disclosures of a single filter element incorporating more than one type of filtering material layer; so that replacement of such a filtering unit does replace more than one type of filtering material. However, the known constructions do not provide a filtering cassette of the type disclosed herein, which has an outstanding combination of advantages, including the following:

1. Compactness,
2. Containment of dirt,
3. Ease of servicing,
4. Flexibility in changing component elements,
5. Structural rigidity,
6. Protection of delicate parts,
7. Ease of assembly and disassembly for cleaning,
8. Improved grounding of the electrostatic elements,
9. Simple arrangement for locking in the filter elements.

The aspects of this invention which provide the listed advantages will be made apparent as the disclosure proceeds.

SUMMARY OF THE INVENTION

This invention relates to a filter cassette structure comprising a central metallic framework which (a) provides a protective and grounding enclosure for an electrostatic filter device mounted within it, and (b) has one or more carrier flanges extending from the framework to provide support for readily removable separate filter elements.

BRIEF DESCRIPTION OF THE DRAWINGS

FIGS. 6 through 12 show, as a separate unit, the electrostatic filtering structure included in the preceding figures. FIG. 6 is a front view, partly in section, showing the upstream, or air entering, side.

FIG. 7 is a rear view, showing the downstream, or air exiting, side.

FIG. 8 is a side elevation, and

FIG. 9 is a plan view, of the electrostatic filtering structure.

FIGS. 10, 11 and 12 are cross-sectional views taken, respectively, on the lines 10—10 of FIG. 6, and 11—11 and 12—12 of FIG. 7.

DETAILED DESCRIPTION OF THE PREFERRED EMBODIMENT

Figure 1:
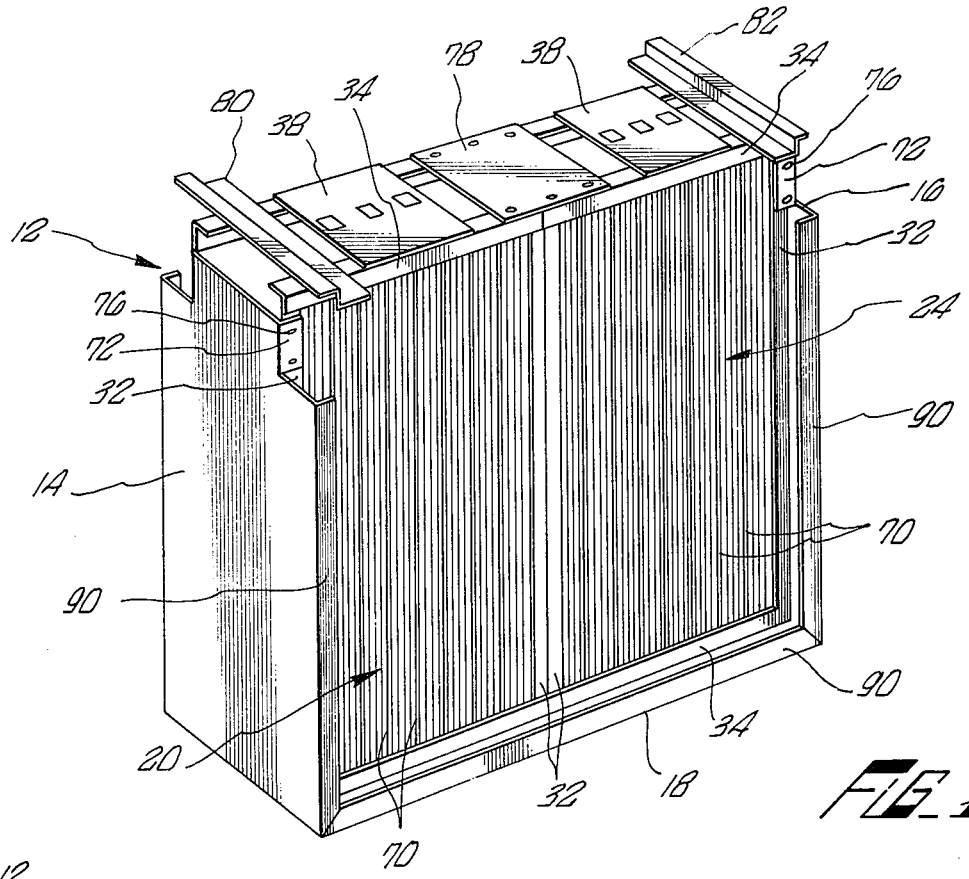
FIG. 1 is a perspective view showing the central framework which constitutes the supporting portion of my filter cassette, and which includes the electrostatic filter device.
Figure 2:
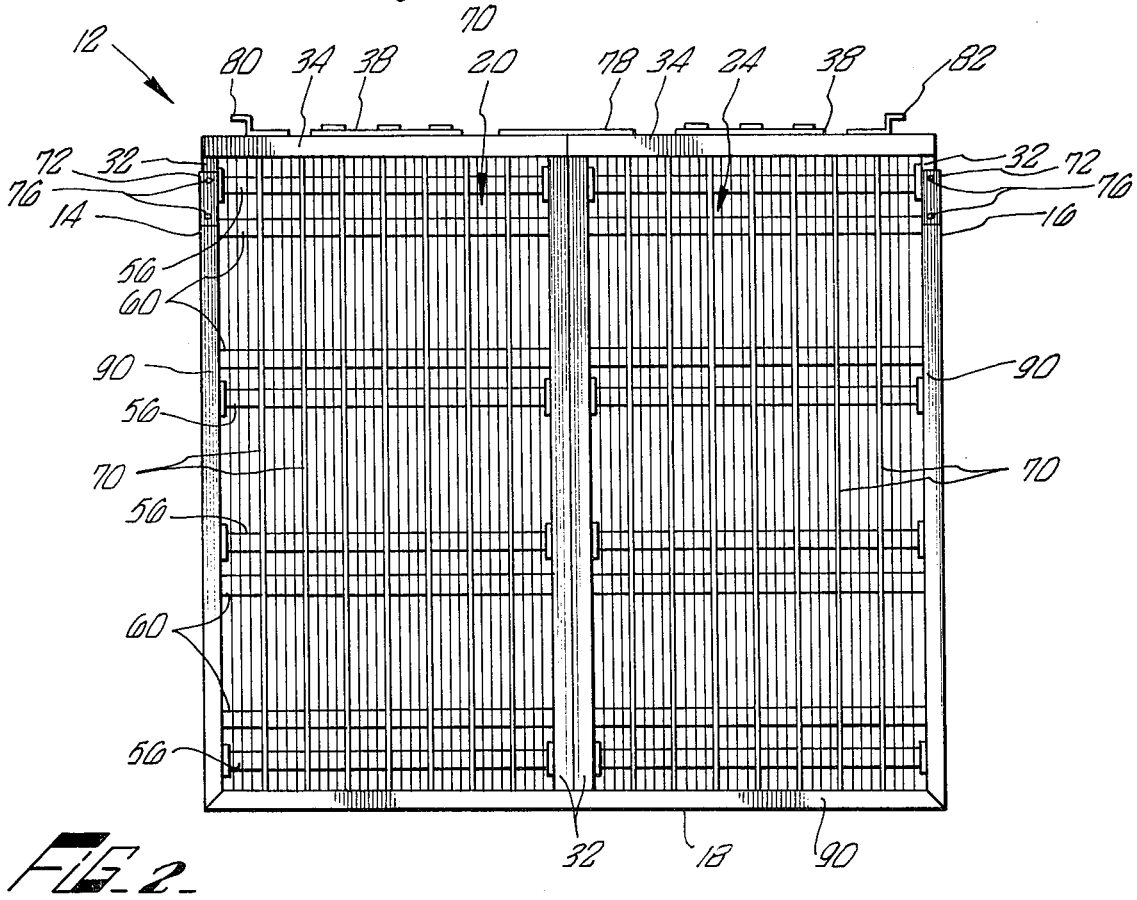
FIG. 2 is a front view, or view from the upstream side, of the central metallic framework of the filter cassette structure of FIG. 1.
Figure 3:
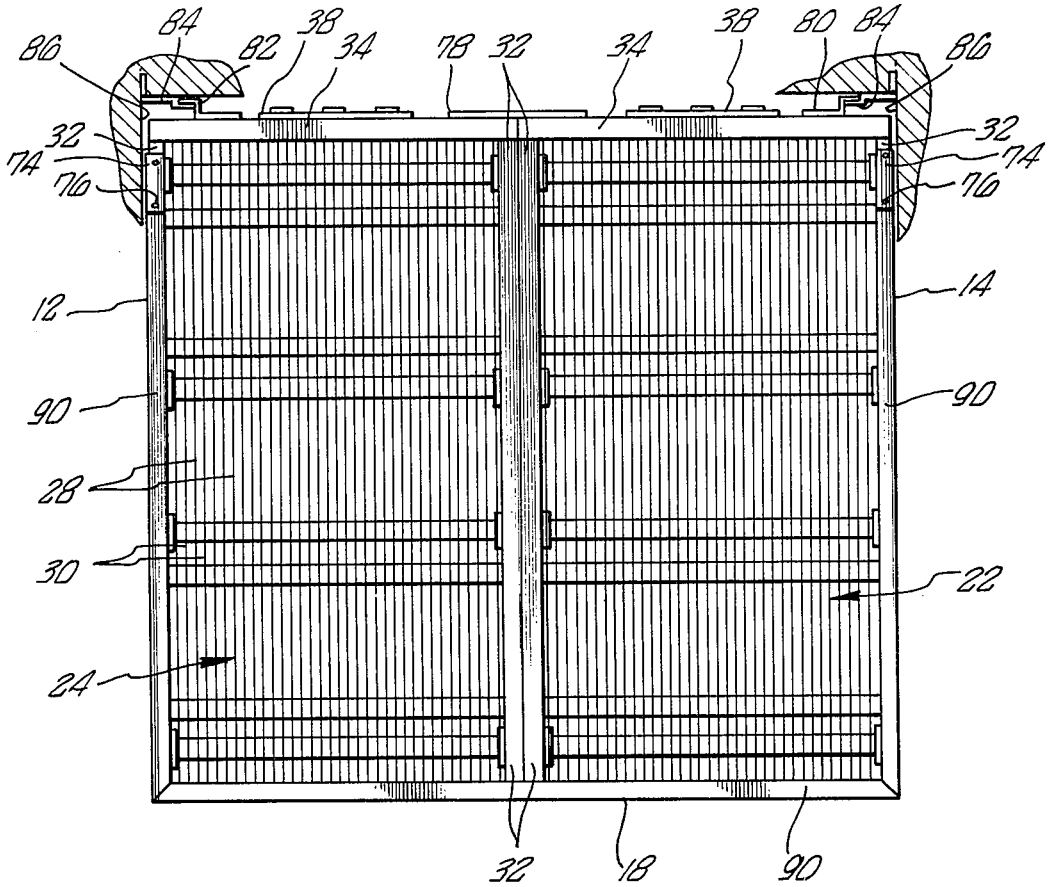
FIG. 3 is a rear view, or view from the downstream side, of the central metallic framework of the filter cassette structure of FIG. 1.

The heart, or core, of my filter cassette in the metal structure, or framework, 12 shown alone without the additional filtering elements in FIGS. 1, 2, and 3. The metal structure 12 provides a rigid supporting framework for the filter cassette. In the illustrated embodiment, the sidewalls 14 and 16 and the lower, or bottom, wall 18 of the metal structure constitute an essentially U-shaped sheet metal enclosure. This metal enclosure is rigidly connected to the metal frame of an electrostatic filtering structure indicated generally by the numeral 20. The electrostatic filter constitutes the heart of the filtration system, and its metallic frame, which supports its internal elements and also provides electrical grounding, is so connected to the U-shaped metal enclosure that they constitute a unitary filter cassette frame, which is inserted and removed from the air duct as a single structure for servicing purposes.

The electrostatic filtering structure is shown separately in FIGS. 6–12 as it appears prior to its combination with the U-shaped metal enclosure.

I have found that an effective electrostatic filtering unit for my filter cassette structure is the unit available from a supplier of such devices under the designation "FC37A Electronic Cell". In FIGS. 6–12, two of these units 22 and 24 are shown mounted side-by-side to provide the desired width of filter cassette.

Each of the electrostatic filter units 22 and 24 is a two-stage filter, having three electrical charge values—a high voltage, an intermediate voltage, and ground. In these units, the high voltge is supplied by an 8,000 volt DC source, and the intermediate voltage is supplied by a 4,000 volt DC source.

The air entering the front of the units (shown in FIG. 6) first passes by the vertically-extending high voltage (8,000 volts) ionizing wires 26 (made of thoriated tungsten), and then flows toward the collector plates 28 and 30 located at the rear of the units (shown in FIG. 7). The collector plates 28 and 30 (made of aluminum) extend parallel to the direction of air flow and show their vertical rear edges in FIG. 7. The collector plates 28 alternate with the collector plates 30 across the width of the units 22 and 24; and the two sets of alternated collector plates are maintained at different potentials. The plates 28 are connected to the intermediate voltage (4,000 volts), and the plates 30 are connected to ground. Thus, the two-stage electrostatic filter units essentially establish a primary electrostatic field extending parallel to air flow between the ionizing wires 26 and the collector plates 28 and 30, and a secondary electrostatic field extending at right angles to air flow between the 4,000 volt plates 28 and the grounded plates 30. The particles in the air are ionized by charges from the wires 26, and are drawn toward the relatively negative collector plates. They are also subjected to lateral deflection forces from the intermediate voltage plates 28 toward the adjacent grounded plates 30.

Each of the electrostatic filter units 22 and 24 has an external frame comprising two flanged side plates 32 and four L-section cross bars 34 which rigidly connect the side plates at top and bottom, and at front and back, of the frame.

Figure 11:
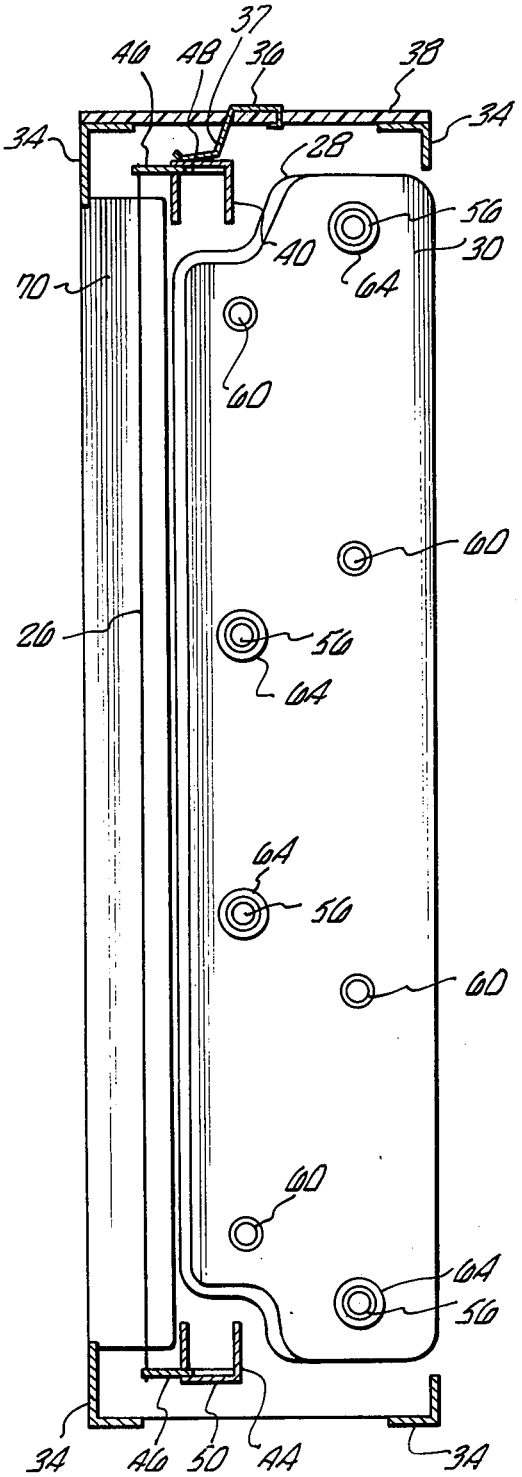

The electrical connections of the three voltage levels are as follows. The 8,000 volt source in each of the units 22 and 24 is connected to the center contact plate 36 supported in an insulating plate 38 secured to the top of the unit by attachment to the front and back cross bars 34. The contact plate 36, as seen in FIG. 11, as a resilient metal arm 37 in electrical contact with a horizontal cross bar 40, which extends horizontally across the electrostatic filtering unit near the top, and which is supported at its ends by insulating plugs 42 (see FIG. 8) mounted in the side plates 32 of the filtering unit. A similar cross bar 44 extends horizontally across the electrostatic filtering unit near the bottom, and is supported at its ends by similar insulating plugs 42 mounted in the side plates 32 of the filtering unit. The ionizing wires 26 extend from the top cross bar 40 to the bottom cross bar 44. In order to provide highly effective electrical conduction, the ends of the ionizing wires are connected to spring fingers 46 (made of beryllium copper) at both the upper and lower ends of the wires. The fingers 46 are preferably interconnected by continuous horizontally extending thin copper strips 48 (at the top) and 50 (at the bottom) which are supported by the respective cross bars 40 and 44. The spring fingers 46 tension the ionizing wires 26 to hold them firmly in position vertically.

The 4,000 volt source in each of the units 22 and 24 is connected to two content plates 52, which are supported in the insulating plate 38 at positions spaced from the center contact plate 36. Each of the contact plates 52 has a resilient metal arm 54 which engages the front edges of a plurality of the collector plates 28 (see FIG. 12). As shown in FIG. 11, the collector plates 28 extend slightly farther toward the front, or upstream, side of the unit than do the collector plates 30. Thus, the plates 30 are not in electrical contact with the arms 54. The collector plates 28 are mechanically and electrically interconnected by a plurality of metallic hollow rods 56 which extend horizontally across the unit and are supported in the side plates 32 by means of insulating plugs 58. The collector plates 28 are swaged to the hollow rods 56.

Figure 12:
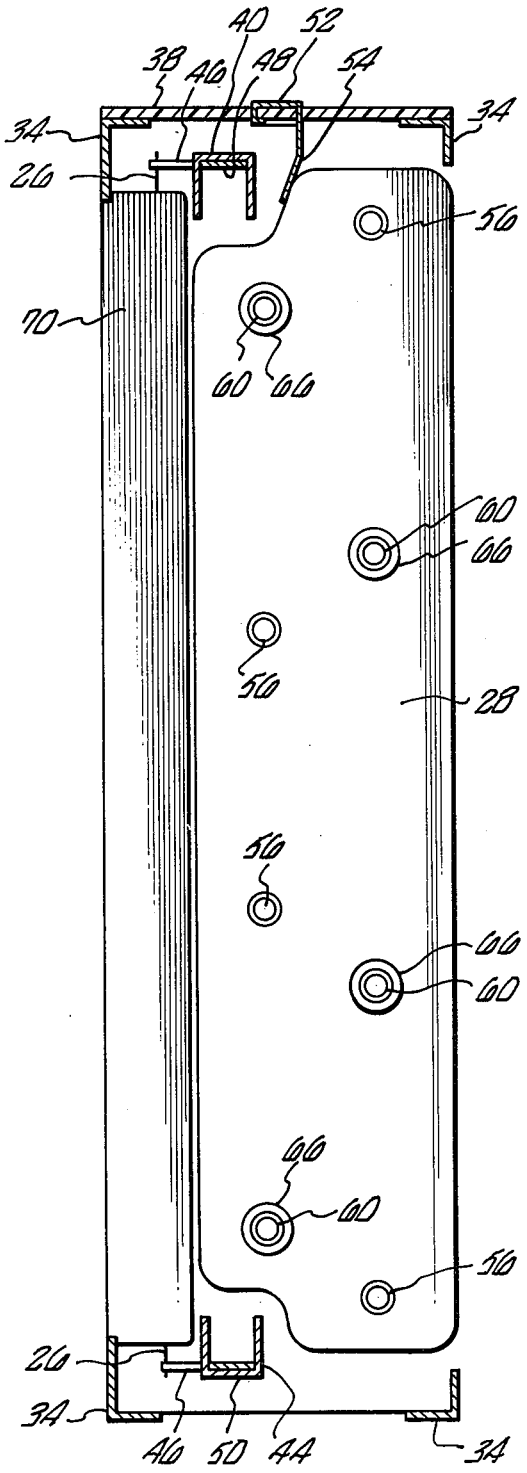

Both the support and electrical grounding of the collector plates 30 are accomplished by their mechanical and electrical connection to a plurality of horizontally extending metallic hollow rods 60, the plates 30 being swaged to the rods 60. At least some of the rods 60 are secured by metallic bolts 62 to the side plates 32, and the others also have metal-to-metal contact with the side plates. The frame of the electrostatic filtering unit is grounded, as will be further explained below. As seen in FIGS. 11 and 12, the hollow rods 56, which are swaged to the intermediate voltage collector plates 28, pass through oversized holes 64 in the grounded collector plates 30 to avoid electrical contact therewith; and the hollow rods 60, which are swaged to the grounded collector plates 30, pass through oversized holes 66 in the intermediate voltage collector plates 28 to avoid electrical contact therewith.

The high and intermediate voltage components are all spaced inwardly from the front and rear faces of the electrostatic filtering units to avoid accidental electrical contact with any external structure. The ionizing wires 26 are set back from the front and each one is mounted between vertical air guide plates 70 which are part of the grounded frame. The rear edges of the grounded collector plates 30 extend beyond the rear edge of the intermediate voltage collector plates 28, so that the latter are spaced somewhat from the rear face of the unit.

The electrostatic filtering units are not per se claimed as part of this invention, but they are related to the invention claimed herein in the sense that they are structurally integrated in the filter cassette.

As shown in FIGS. 1–3, the electrostatic filtering units 22 and 24 are rigidly secured to the U-shaped metal enclosure defined by the side walls 14 and 16 and the bottom wall 18. This may be accomplished in any suitable way, but in the illustrated embodiment the side walls 14 and 16 each have a front flange 72 and a rear flange 74 formed integrally with the side portions at their upper ends and secured by suitable fastening means 76 to the flanged side plates 32 of the metal frames of the two filtering units 22 and 24. For additional horizontal strengthening across the top of the framework of the filter cassette, a metal plate 78 bridges, and is rigidly secured to, the upper cross bars 34 of the two units 22 and 24, both at the front end and rear of the units.

Rigidly interconnected as described, the U-shaped metal enclosure and the frames of the electrostatic filtering elements constitute a unitary structure, which can conveniently be inserted into and removed from the duct, or cabinet, in which the air-moving blower is located.

In order to provide a convenient and very efficient means of grounding the filter cassette to the duct, or cabinet, the top cross bars 34 of the units 22 and 24 have secured thereto two metal rails, or angle guides, 80 and 82 which extend from front to back across the top of the filter cassette. When the filter cassette is inserted in the air duct, the rails 80 and 82 engage the slide along matching tracks, or angle guides, provided in the structure of the duct, or cabinet. For example, in FIG. 3 the rails are shown engaging the tracks 84 with the filter cassette inserted in the duct 86. The rails, which support the filter cassette by their hanging relationship with the tracks, provide continuous electrical contact with the grounded duct throughout their length, so multiple point, redundant grounding contact is provided. Although FIG. 3 is used to illustrate the rail and track engagement it should be noted that the additional filter elements shown in FIGS. 4 and 5 would be in place when the cassette is in the duct. Attention is also called to the fact that the cassette is inserted directly into the open end of the duct, rather than being slid laterally into place.

It will be apparent that an extremely reliable and safe grounding system has been provided, and that other filter components can abut the metalwork in the framework structure 12 without any change of making contact with high voltage components. The filter cassette, therefore, is safe to touch when in operation, provided the additional filter elements are in place.

Figure 5:
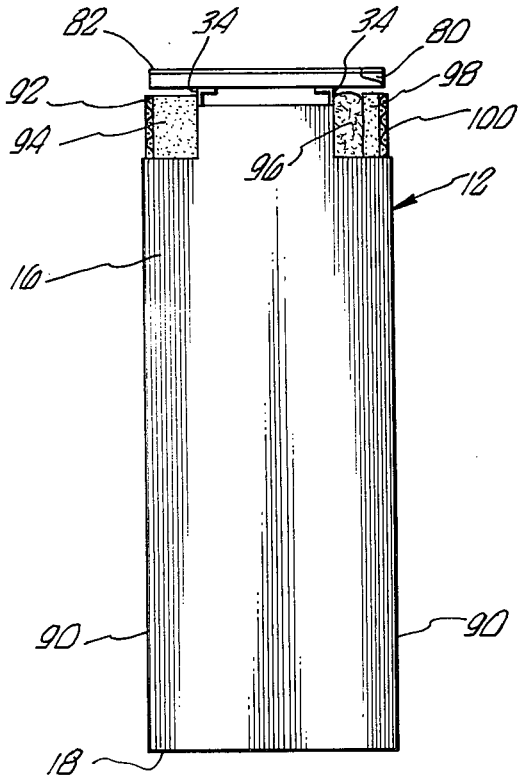
FIG. 5 is a side view, partly in cross-section, of the complete filter cassette of FIG. 4, the cassette being shown in its partially installed position in an air flow duct, or cabinet, in which it is intended to be mounted.
Figure 4:
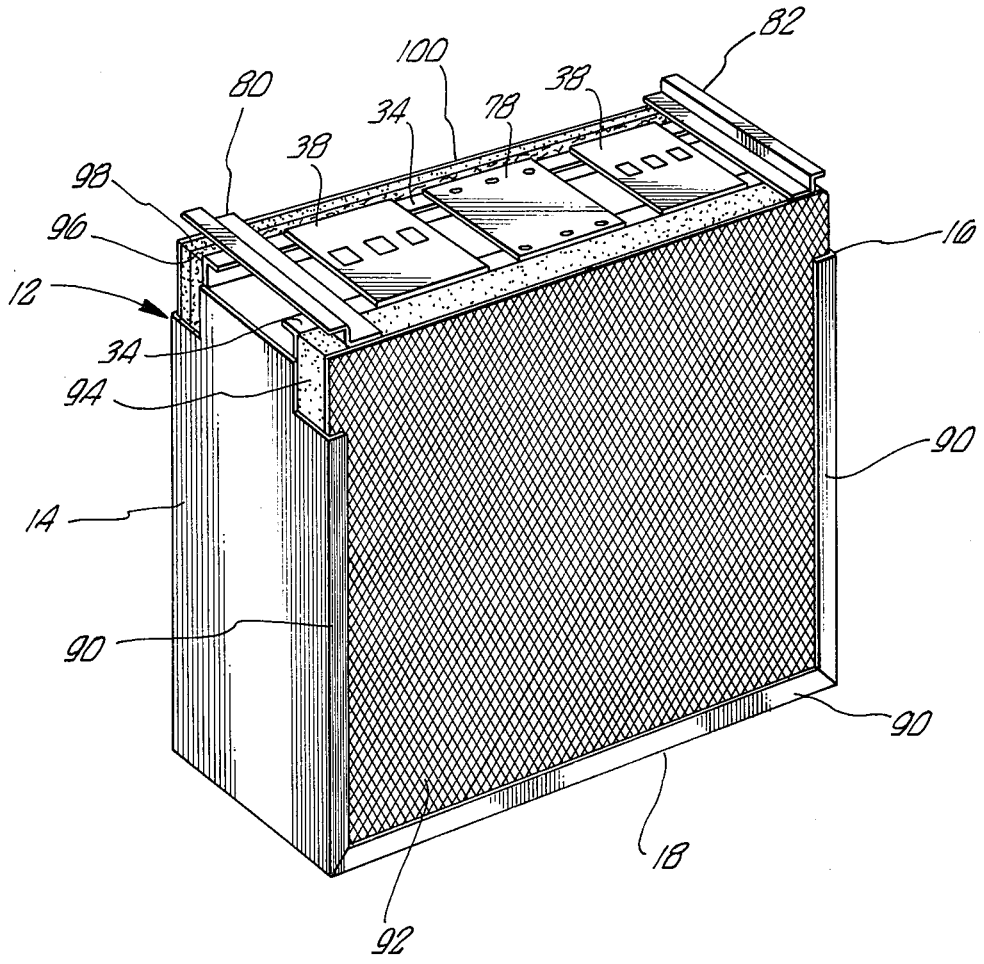
FIG. 4 is a perspective view showing the filter cassette with the additional filtering units and end closure members installed, thereby providing a complete filter cassette ready for installation in an air duct.
Figure 6:
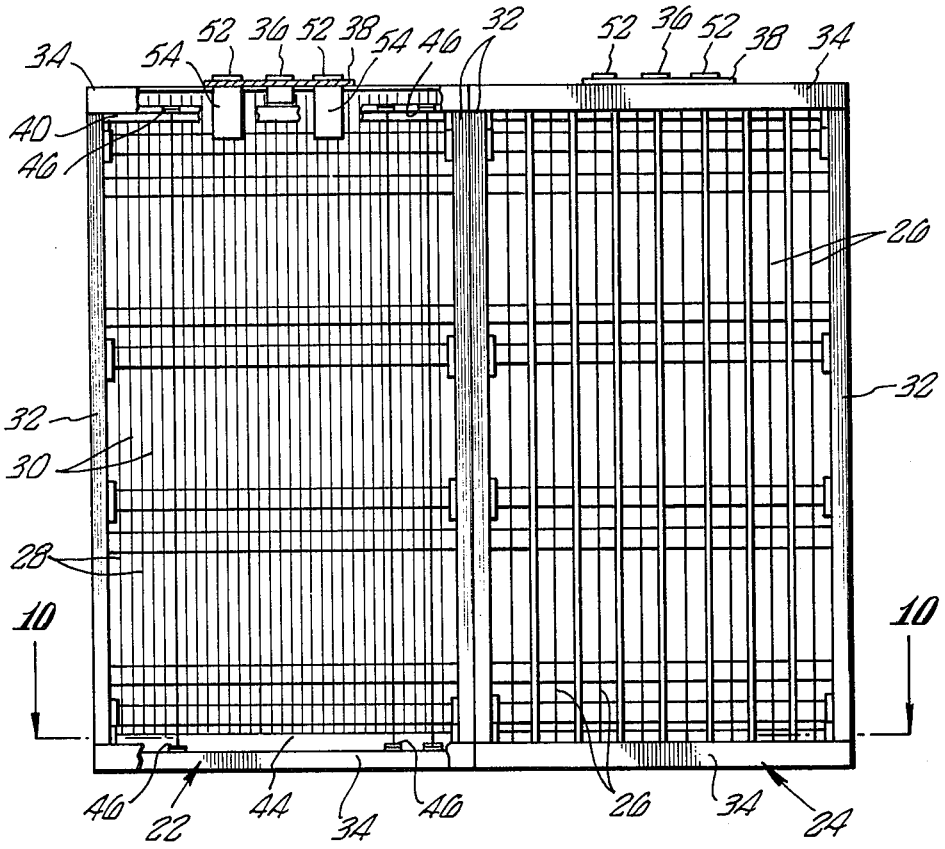
Figure 10:
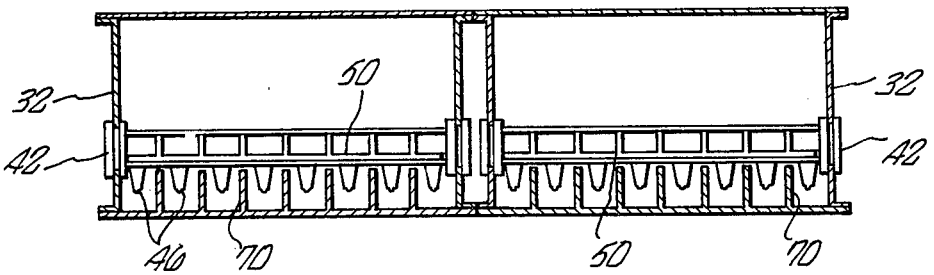

FIGS. 4 and 5 show a complete filter cassette unit having the additional filter elements in place as they would normally be when installed in the duct, or cabinet. The entire cassette is installed and removed as a unit for cleaning purposes. The separate filtering elements may then be removed from the framework 12 and separately cleaned. When a filter cassette is removed for servicing, another cassette is installed in its place. Cleaning and servicing are then accomplished at a central service location where the ideal conditions and materials for such work can be conveniently maintained. The cleaned filter cassette unit can then be reused in any air filtering system which it fits.

As shown in the drawings, the essentially U-shaped exterior wall of the framework 12, which is constituted by the side walls 14 and 16 and the bottom wall 18, extend beyond both the front, or upstream, face and the rear, or downstream, face of the framework 12. At both the upstream and downstream sides, an inwardly-extending retaining flange 90 is formed on, or secured to, the U-shaped exterior wall to serve as a holder for the additional filter elements. Both the upstream and downstream sides of the framework 12 thus provides a carrier, or tray, extension which supports and retains in position the additional filtering elements. Also, the two rails 80 and 82 extend to the upstream and downstream edges of the U-shaped wall of the framework, so they overlie, and prevent removal of, the additional filtering elements after the latter have been installed. Removal of the rails 80 and 82 when the filter cassette is brought in for servicing permits easy access to, and removal of, the additional filtering elements.

The choice of additional filtering elements for a particular installation depends on the primary requirements of the air filtering system in which the cassette is installed. For example, the filtering requirements for a machine shop and a beauty parlor are quite different. A beauty parlor installation would probably require a relatively large amount of odor-removing material and a relatively small amount of particle-removing material, whereas a machine shop installation would require a relatively large amount of particle-removing material and little or no odor-removing material.

The filter cassette disclosed herein permits an unlimited range of filter material combinations.

In the embodiment shown in FIGS. 4 and 5, a combination of filter elements is shown which comes closest to being a "standard package", i.e., it is suitable for a wide range of installations. Starting at the front, or upstream, side, there is a metal grille, or screen, 92 which acts as a retainer for the inserted upstream filter element or elements. The pre-filter element 94 is a particle intercept filter for large particles. The pre-filter 94 and screen 92 rest on the bottom wall, or floor, 18 of the framework 12, and are supported and held in place by the flange 90, which extends along the bottom and both sides of the cassette. After the rails 80 and 82 have been secured by any convenient fastening-unfastening means such as nuts and bolts (not shown), for example to the L-section cross-bar 34, the elements 92 and 94 are fully retained, and will drop out even if the cassette is turned upside down during handling.

At the rear, or downstream, side of the cassette, next to the framework 12, the first post-filter element 96 is an activated carbon (charcoal) filter for odor containment. Then there is another post-filter element 98 for particle removal. This is used to prevent any agglomerated particles from coming through. Again, a metal grille, or screen, 100 serves as a retainer for the inserted downstream filter elements; and the three elements 96, 98, and 100 are supported and held in place by the floor 18 of the framework, the sides 14 and 16, and the flange 90 provided on the sides and on the floor.

The primary particle removing portion of the filter cassette is, of course, the electrostatic filter comprising ionizing and collecting sections.

Both the pre-filter particle-collecting element 94 and the post-filter particle-collecting element 98 may consist of polyurethane foam material. Obviously, however, other types of filter elements, and filter elements having different thicknesses, could be readily substituted for elements 94 or 98, or for the odor-removing element 96.

The following is a recapitulation of the several advantages combined in the filter cassette structure disclosed in this application:

1. Compactness — The arrangement provides for an insertion of the desired filtering elements without wasting intermediate space. Space between filter elements serves no useful purpose.

2. Containment of dirt — As has been disclosed, the cassette provides an enclosure at the bottom and on both sides of the unit. The floor, or bottom, 18 of the U-shaped enclosure provides a tray, or container, which will catch and hold any dirt falling out of the cassette, either when the blower is turned off, or when the cassette is being removed from the duct, or cabinet, for servicing. This avoids a common and very annoying problem in the use of filter units, which results from accidental, but heretofore largely unavoidable, displacement of collected dirt into the air flow passage when the filter element is jarred or tipped.

3. Ease of servicing. — Since the entire multi-element filtering package is contained in a single cassette, a service man (or anyone) can remove all the elements of the filtration system from the unit at one time. This makes it easier for a person removing the unit to work on a step ladder if the filtering cassette is mounted on a ceiling or at any other location which cannot be reached from the ground. In removing the filter, it is necessary to deal with only a single piece of equipment.

4. Flexibility in changing component elements. — It is a simple matter to vary the pre-filter and post-filter elements, which are placed in the trays provided by the framework, to provide whatever combination of air filtering capabilities is required by a particular installation.

5. Structural rigidity. — Not only does the obviously rigid structure of the framework provide a container for the filtering elements, but it also permits reduction of the structural members within the duct, or cabinet, inasmuch as the filter cassette contributes to the support of the cabinet structure, rather than depending upon the cabinet structure for its own support and structural integrity.

6. Protection of delicate parts. — The electrostatic ionizer section contains fragile ionizing wires, and the collector section contains delicate, thin plate material. Positioning the electrostatic filter cell within the metal framework structure prevents accidental damage to the electrostatic filter and provides protection of the delicate parts in it from contact with the other filter elements while the unit is being transported to and from its installation.

7. Ease of assembly and disassembly for cleaning. — When the filter cassette is brought into the service station for cleaning, the separate pre-filter and post-filter elements are easily and quickly removed, so that they can be cleaned by appropriate procedures. The basic metal framework is itself cleaned in a special cleaning solution. After the cleaning process has been completed, the unit is reassembled.

8. Improved grounding of the electrostatic elements. — As previously explained, the metal framework provides a very complete and reliable grounding system and grounding contact for the electrostatic filter.

9. Simple arrangement for locking in the filter elements. — The metal mesh retainers 92 and 100 hold the filter elements in place, and the entire package is locked in when the sliding rails 80 and 82 have been secured to the top of the cassette. The entire filter cassette unit is then ready to be handled with a minimum amount of difficulty.

The variety of modifications of the exemplary embodiment which come within the general concept of my invention will be apparent from the following claims.

What is claimed is:

1. An air-filtration cassette designed to be inserted and removed from an air-flow duct as a unit, the air-flow duct supporting said cassette when in place in the duct, said air-filtration cassette comprising:

a metallic supporting framework having two side walls and one bottom wall joined together into a U-shaped profile, a flange extending along the front and back perimeters of the U-shaped profile, both side walls having a shorter width at the open end of the U-shaped profile than at the bottom end, the bottom part of the two side walls and the bottom wall thereby forming an upstream and a downstream carrier tray;

at least one electrostatic ionizer and collector cell mounted within a frame and fastened to the front and back flanges of the side walls along this shorter width, in a manner that provides a space between the bottom of the collector cell and the bottom wall of said framework;

a pre-filtering element having substantially the same filtering surface as the cross section of said supporting framework, said pre-filtering element being supported on one side of said electrostatic cell by the upstream carrier tray of said supporting framework;

a post-filtering element having substantially the same filtering surface as the cross section of said supporting framework, said post-filtering element being supported on the other side of said electrostatic cell by the downstream carrier tray of said supporting framework; and at least a pair of angle guides removably fastened to the top of said electrostatic cell parallel to the sides of said supporting framework at the open end of its U-shaped profile, said angle guides extending over and holding said pre-filtering and post-filtering elements into their respective carrier trays, the entire air-filtration cassette being fastened to and supported by the air-flow duct through said guides.

2. The air-filtration cassette of claim 1 wherein two electrostatic ionizer and collector cells are mounted within and fastened to the front and back flanges of the side walls along their shorter width, said cells being mounted side by side and held together at their abutting sides by a metal plate fastened to both cells.

3. The air-filtration cassette of claim 1, further comprising at least one insulating plate fastened to the top of said collector cell, said insulating plate supporting at least one electrical contact plate, said contact plate including a resilient metal arm for making electrical contact with said electrostatic cell.

4. The air-filtration cassette of claim 1 wherein said pre-filtering element includes a metal grill and a particle-filter material sandwiched together, said metal grill being placed upstream from said particle-filter material.

5. The air-filtration cassette of claim 1 wherein said post-filtering element includes a metal grill, a particle-filter material, and activated carbon sandwiched together, said metal grill being placed downstream from said particle-filter material.

* * * * *